US007311801B2

(12) United States Patent
Ono et al.

(10) Patent No.: US 7,311,801 B2
(45) Date of Patent: Dec. 25, 2007

(54) NEWSPRINT PAPERS

(75) Inventors: Hiroshi Ono, Tokyo (JP); Satoshi Ishioka, Tokyo (JP); Fuminari Nonomura, Tokyo (JP); Yasunori Nanri, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 527 days.

(21) Appl. No.: 10/780,558

(22) Filed: Feb. 19, 2004

(65) Prior Publication Data

US 2004/0177938 A1 Sep. 16, 2004

(30) Foreign Application Priority Data

Feb. 21, 2003 (JP) ..... 2003-045182

(51) Int. Cl.
*D21H 19/10* (2006.01)
*D21H 17/17* (2006.01)
*D21H 17/67* (2006.01)
*D21H 11/14* (2006.01)

(52) U.S. Cl. ..... 162/135; 162/181.2; 162/158; 162/175; 162/147; 428/195.1

(58) Field of Classification Search ..... 162/135, 162/158, 175, 147, 179, 181.1, 181.2, 150; 428/195.1, 340–342
See application file for complete search history.

(56) References Cited

U.S. PATENT DOCUMENTS

| | | | | | |
|---|---|---|---|---|---|
| 5,368,689 | A * | 11/1994 | Agnemo | ..... | 162/135 |
| 5,374,335 | A * | 12/1994 | Lindgren et al. | ..... | 162/158 |
| 5,376,237 | A * | 12/1994 | Ishiguro et al. | ..... | 162/134 |
| 5,698,305 | A * | 12/1997 | Suzuki et al. | ..... | 428/219 |
| 5,755,930 | A * | 5/1998 | Satterfield et al. | ..... | 162/164.1 |
| 5,824,190 | A * | 10/1998 | Guerro et al. | ..... | 162/135 |
| 5,846,663 | A * | 12/1998 | Brungardt et al. | ..... | 428/537.5 |
| 6,123,760 | A | 9/2000 | Varnell | | |
| 6,783,847 | B1 * | 8/2004 | Minami et al. | ..... | 428/331 |
| 2003/0106659 | A1 * | 6/2003 | Malmstrom et al. | ..... | 162/158 |
| 2006/0037512 | A1 * | 2/2006 | Pawlowska et al. | ..... | 106/16 |
| 2006/0060814 | A1 * | 3/2006 | Pawlowska et al. | ..... | 252/8.83 |
| 2006/0225854 | A1 * | 10/2006 | Ono et al. | ..... | 162/158 |

FOREIGN PATENT DOCUMENTS

| | | |
|---|---|---|
| EP | 0 220 941 | 5/1987 |
| JP | 58-8200 | 1/1983 |
| JP | 62-125094 | 6/1987 |
| JP | 63-28997 | 2/1988 |
| JP | 2-15677 | 4/1990 |
| JP | 4-361687 | 12/1992 |
| JP | 4-361688 | 12/1992 |
| JP | 5-41755 | 6/1993 |
| JP | 7-119078 | 5/1995 |
| JP | 07119078 A * | 5/1995 |
| JP | 07138898 A * | 5/1995 |
| JP | 7-65280 | 7/1995 |
| JP | 3041622 | 3/2000 |
| JP | 2002-528658 | 9/2002 |

* cited by examiner

*Primary Examiner*—José A. Fortuna
(74) *Attorney, Agent, or Firm*—Roylance, Abrams, Berdo & Goodman, L.L.P.

(57) ABSTRACT

The object of the present invention provides a newsprint paper having a friction coefficient in an appropriate range, a sufficient sizing quality, a low "neppari" strength and excellent printability. A newsprint paper having a static friction coefficient in an appropriate range of 0.44-0.74, a sufficient sizing quality and a low "neppari" strength can be obtained by applying a coating solution containing an alkenyl ketene dimer represented by general formula 1 below and a paper surface-modifying agent on a newsprint base paper, especially a neutralized newsprint base paper containing 1% by weight or more and 30% by weight or less of calcium carbonate as a filler and 50% by weight or more of deinked pulp.

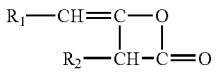

(1)

wherein $R_1$ and $R_2$ represent an unsaturated hydrocarbon group containing 8-30 carbon atoms.

5 Claims, No Drawings

NEWSPRINT PAPERS

BACKGROUND OF THE INVENTION

The present invention relates to newsprint papers having a friction coefficient in an appropriate range and a sufficient sizing quality.

As four-color offset printing has become a mainstream printing process for newsprint papers, it is increasingly important to control the friction coefficient within an appropriate range. Newsprint papers having a high friction coefficient may cause runnability problems such as wrinkles during printing, while those having a low friction coefficient may cause printability problems such as layer-to-layer slippage. It is also important for newsprint papers to show resistance to wetting by fountain solution (sizing quality) to prevent paper breakage, color drift and tension loss caused by the increased number of times that the fountain solution is transferred in four-color printing.

Modern newsprint papers tend to have a higher friction coefficient because the high proportion of deinked pulp means a relatively low proportion of mechanical pulp and therefore smaller amounts of extracts carried from the mechanical pulp, or they contain calcium carbonate as a filler to form neutralized papers.

Conventional methods for decreasing the friction coefficient of paper include internal application of an alkyl ketene dimer (AKD) or talc or external application of a lubricant for coating pigments. However, these methods are not preferable for preparing high quality papers. If AKD is internally applied, AKD migrates within the roll of paper so that the friction coefficient of outer layers of the roll decreases significantly to cause layer-to-layer slippage during printing. If talc is internally applied, the proportion of fillers having a high specific scattering coefficient such as white carbon and calcium carbonate decreases relatively and therefore, the opacity of paper decreases. Lubricants for coating pigments such as polyethylene wax lubricants (see JP-A H03-137295) and styrene lubricants (see JP-A S58-8200) show low dispersion stability in coatings of pH 7.0 or less, and form aggregates called scum under shear during coating, which results in serious operational problems. This problem occurs in newsprint papers, which are typically coated with a coating of pH 7.0 or less containing starch and a surface sizing agent without pigments.

Therefore, it is desirable to develop a chemical agent capable of controlling the friction coefficient of newsprint papers, especially neutralized newsprint papers, within an appropriate range.

On the other hand, the recent prevalence of four-color printing dictates that about 4 times as much fountain solution is loaded as in monochrome printing, with the result that more adhesive materials are released from newsprint papers and deposited on the blanket. Moreover, high DIP levels or neutral papermaking conditions compromise the self-sizing property of base papers to cause an increase in their surface free energy, resulting in an increase in the energy of adhesion between the paper and the blanket (in other words, the energy required for separating paper from the blanket), whereby "neppari" problems are more likely to occur.

Water-soluble components contained in newsprint papers are dissolved in a fountain solution used during offset printing. The resultant solution is accumulated on a blanket for use in offset printing. "Neppari" is caused by adhesion or tackiness of the resultant solution, whereby a problem such as bad paper runnability or paper break is encountered.

Newsprint papers can be sized in two ways, i.e. internally and externally. Sizing agents used for internal application to neutralized papers are reactive sizing agents such as alkyl ketene dimers (hereinafter referred to as AKD) and alkenyl succinic anhydrides, but the sizing agents are not wholly retained in paper and unretained sizing agents are hydrolyzed in white water to form deposits, which contaminate paper machines or press rolls. In stock systems containing high levels of mechanical and deinked pulps such as stocks for newsprint papers, a significant amount of anionic trash is included and any cationic emulsified AKD internally added as a sizing agent binds to the anionic trash but not to pulp fibers, and therefore, AKD loadings must be increased to afford an effective sizing quality, and the sizing quality varies with the amount of anionic trash in the stock systems. Moreover, the sizing effect develops too slowly to afford an appropriate sizing quality by internal application of AKD when on-machine sizing is required.

An alternative approach is external application, i.e. application of a surface sizing agent. Surface sizing agents are typically applied to newsprint papers using gate roll coaters capable of forming/transferring films at high speed. However, it is difficult to obtain a sizing effect from polymeric sizing agents known as surface sizing agents such as styrene-maleic copolymers, styrene-acrylic copolymers and olefin-maleic copolymers, because they are designed to be applied to wet paper in the form of a weak coating solution as used with size press coaters, and they afford a sizing effect after drying, and therefore, they cannot sufficiently bind to pulp fibers due to the poor penetration of the coating solution into paper layers even if they are applied with gate roll coaters.

Thus, a method for applying AKD on newsprint papers was proposed (see JP-A H07-119078), but a large amount of AKD must be applied to afford an effective sizing quality because typical newsprint papers made from acidic stocks at pH 4.5-5.5 have a surface pH of 4.5-5.5, which is below the alkalinity required for AKD to produce an appropriate sizing effect, and the sizing effect develops slowly. To control the friction coefficient in an appropriate range, an anti-slip agent had to be applied at the same time.

SUMMARY OF THE INVENTION

As described above, it is desirable to develop a surface sizing agent capable of conferring an effective sizing quality on newsprint papers, especially neutralized newsprint papers to control the friction coefficient within an appropriate range. An object of the present invention is to provide a newsprint paper having a friction coefficient in an appropriate range, a low "neppari" strength and a sufficient sizing quality, especially a newsprint paper best suited for four-color offset printing.

As a result of careful studies in view of the problems of the prior art above, we found that a newsprint paper having a static friction coefficient in an appropriate range of 0.44-0.74, a low "neppari" strength and a sufficient sizing quality can be obtained by selecting a specific alkenyl ketene dimer as a surface sizing agent and applying and drying a coating solution containing this sizing agent and a paper surface-modifying agent such as a starch on a newsprint base paper. Especially, a sufficient sizing quality can be conferred on even neutralized newsprint papers in which calcium carbonate is used as a filler.

DETAILED DESCRIPTION OF THE INVENTION

In the present invention, a specific alkenyl ketene dimer is used as a surface sizing agent. This alkenyl ketene dimer is based on a compound represented by general formula (1) below:

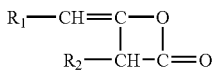

(1)

wherein $R_1$ and $R_2$ represent an unsaturated hydrocarbon group containing 8-30 carbon atoms. For example, straight unsaturated $C_{8-30}$ hydrocarbon groups having one double bond include octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, triacontenyl and the like.

In the alkenyl ketene dimer represented by general formula (1) above, $R_1$ and $R_2$ preferably represent an unsaturated hydrocarbon group containing 14-22 carbon atoms. $R_1$ and $R_2$ are not limited to straight hydrocarbons, but may be branched or cyclic. This alkenyl ketene dimer is preferably liquid in a range of 5-50° C.

The alkenyl ketene dimer may be used as an aqueous dispersion with various known emulsifiers. The alkenyl ketene dimer can be dispersed in aqueous media by various known methods.

Paper surface-modifying agents used in the present invention include known agents used for conventional paper surface treatments. For example, at least one member selected from the following list can be used: starches such as oxidized starches, esterified starches, etherified starches, cationic starches and enzyme-modified starches; cellulose derivatives such as carboxymethylcellulose, hydroxyethylcellulose and methylcellulose; polyacrylamides; polyvinyl alcohols; modified alcohols such as carboxyl-modified polyvinyl alcohols and acetoacetyl polyvinyl alcohols; styrene-butadiene copolymers, polyvinyl acetates, vinyl chloride-vinyl acetate copolymers, polyvinyl chlorides, polyvinylidene chlorides, polyacrylic esters and the like. These paper surface-modifying agents are applied in the form of an aqueous solution or aqueous latex containing them. These paper surface-modifying agents are used alone or in combination of two or more to improve surface strength or prevent dusting or for other purposes.

The paper surface-modifying agents used in the present invention play an important role in improving surface strength, especially preventing dusting. However, they also invite "neppari" problems inherent to newsprint papers (i.e. troubles caused by paper surface-modifying agents transferred to and accumulated on the blanket when newsprint papers are printed in large quantities). Considering a balance between surface strength-improving effects and "neppari" problems, paper surface-modifying agents that can be preferably used among the examples mentioned above are starches, most preferably modified starches such as oxidized starches, etherified starches and esterified starches.

The alkenyl ketene dimer and the paper surface-modifying agent are preferably contained in a ratio of the former to the latter of 1-30% by weight. The sizing quality is not sufficiently improved if the alkenyl ketene dimer is less than 1% by weight, while it is meaningless to include it in excess of 30% by weight because the sizing quality levels off. The paper surface-modifying agent is preferably coated in an amount of 0.1-1.0 g/m$^2$.

According to the present invention, newsprint papers with sufficient sizing quality and little decrease in friction coefficient are obtained by coating a newsprint base paper with a coating solution containing an alkenyl ketene dimer having a specific structure and a paper surface-modifying agent. When the alkenyl ketene dimer of the present invention is applied, newsprint papers having a friction coefficient in an appropriate range and a sufficient sizing quality can be obtained without using any anti-slip agent, in contrast to conventional newsprint papers coated with alkyl ketene dimers involving the use of anti-slip agents to compensate for a significant decrease in friction coefficient.

The newsprint papers of the present invention must have a static friction coefficient in the range of 0.44-0.74. If the static friction coefficient is less than 0.44, problems may occur such as layer-to-layer slippage or tension loss during printing. If the static friction coefficient is higher than 0.74, however, paper runnability may deteriorate.

The sizing quality can be effectively afforded by further treating the newsprint base paper in a calender such as a soft calender, machine calender or supercalender on the surface coated with a coating solution containing an alkenyl ketene dimer of the present invention and a paper surface-modifying agent. The calender desirably has a surface temperature of 50° C. or more.

The resistance to water absorption (sizing quality) of the newsprint papers of the present invention is not specifically limited but can be appropriately determined depending on the product specifications required. For example, it can be defined as a droplet absorption in the range of 10-1000 seconds, more preferably 15-800 seconds as measured by a droplet absorption test (according to Japan TAPPI No. 33 (a test measuring the time required for a 1-μl water droplet on a paper surface to be absorbed into the paper surface)). It can also be preferably defined as a contact angle of 90 degrees or more and 110 degrees or less 0.1 second after placing a 5 μl water droplet on a paper surface as measured by a test based on the contact angle of a water droplet as described in JPA No. HEI8-232193 or JPA No. HEI11-140791 (the contact angle measured a given period after placing a water droplet on a paper surface). The droplet absorption test is rather considered as an evaluation of static sizing quality, while the contact angle test is an evaluation of dynamic sizing quality. The droplet absorption test and the contact angle test are considered to evaluate different events because the former evaluates the behavior of a paper during a period, for example, from wetting the paper with a fountain solution in an offset rotary press to discharging it as a printed matter, while the latter evaluates the behavior of a paper during a period, for example, when the paper passes between cylinders in a color printer such as a satellite printer. For this reason, both aspects must be satisfied in order to improve color printability. Thus, the newsprint papers of the present invention preferably have a droplet absorption in the range of 10-1000 seconds and a contact angle of 90 degrees or more and 110 degrees or less 0.1 second after placing a 5 μl water droplet.

In the present invention, a neutralized newsprint base paper containing calcium carbonate as a filler is preferably used as a base paper. By using calcium carbonate, the alkalinity required for sizing by alkenyl ketene dimers can be sufficiently supplied. More preferably, calcium carbonate is light calcium carbonate having an average particle diameter of 1.0-4.0 μm. The content of calcium carbonate as a filler is preferably 1% by weight or more and 30% by weight or less based on the weight of paper.

The coater for applying the coating solution containing an alkenyl ketene dimer and a surface-modifying agent on the newsprint base paper is not specifically limited, but common coaters such as size presses, blade metering size presses, rod metering size presses, gate roll coaters, blade coaters, bar coaters, rod blade coaters and air knife coaters can be appropriately used.

The newsprint base paper used in the present invention is prepared by a common paper machine from one member or a mixture at given proportions of pulps including mechanical pulps (MP) such as groundwood pulps (GP), thermomechanical pulps (TMP), chemithermomechanical pulps (CTMP) and semichemical pulps; chemical pulps (CP) such as kraft pulps (KP); deinked pulps (DIP) obtained by deinking waste paper containing these pulps; and recycled pulps obtained by disintegrating mill broke from the paper making process. In view of the recent trend to high DIP levels, the proportion of DIP is more preferably in the range of 50-100% by weight. However, newsprint papers tend to have a higher friction coefficient because high proportions of DIP mean relatively low proportions of mechanical pulp and therefore smaller amounts of extracts carried from the mechanical pulp. According to the present invention, the static friction coefficient can be controlled in the range of 0.44-0.74 by using an alkenyl ketene dimer having a specific structure.

The newsprint base paper used in the present invention can contain common paper fillers and wet-end chemicals as appropriate. Suitable fillers other than calcium carbonate include white carbon, clay, silica, talc, titanium oxide and synthetic resin fillers (such as vinyl chloride resins, polystyrene resins, urea-formalin resins, melamine resins and styrene-butadiene copolymers). Wet-end chemicals that can be contained include paper strength enhancers such as polyacrylamide polymers, polyvinyl alcohol polymers, cationic starches, urea-formalin resins and melamine-formalin resins; freeness/retention aids such as salts of acrylamide-aminomethyl acrylamide copolymers, cationic starches, polyethylene imine, polyethylene oxide and acrylamide-sodium acrylate copolymers; sizing agents such as rosin sizing agents, emulsion sizing agents, alkyl ketene dimers (AKD) and alkenyl succinic anhydrides (ASA); and adjuvants such as aluminum sulfate, UV protectors, discoloration inhibitors and antifoamers. The newsprint base paper has a basis weight on the order of, but not limited to, 34-50 g/m$^2$. This newsprint base paper may have physical properties such as tensile strength, tear strength and elongation equivalent to those of conventional newsprint papers as regards printability in offset printers.

EXAMPLES

The following examples further illustrate the present invention without, however, limiting the invention thereto. Unless otherwise specified, parts and% in the examples and comparative examples mean parts by weight and% by weight, respectively.

Example 1

A mixed pulp slurry consisting of 25 parts of TMP, 70 parts of DIP and 5 parts of NBKP (all expressed as the weight of dry pulp) was prepared, and 1.3 parts of aluminum sulfate and 5 parts of calcium carbonate (available under trade name Optical HP from IMERYS; average particle diameter 1.5 μm) were added to 100 parts of this mixed pulp to prepare a neutralized newsprint base paper having a basis weight of 43 g/m$^2$, a thickness of 68 μm and an ash content of 9% in a twin-wire paper machine. A coating solution containing 8.0% of a cooked hydroxyethyl starch (available under trade name ETHYLEX 2025 from STALEY) and 0.8% of a sizing agent consisting of an alkenyl ketene dimer (available under trade name AS-1163 from Japan PMC Corporation; wherein $R_1$ and $R_2$ most frequently contain 18 carbon atoms) was prepared and applied on both sides of the newsprint base paper at a coating density of 1.0 g/m$^2$ (total on both sides) using a gate roll coater at a coating speed of 880 m/min. The coating density, friction coefficients, "neppari" strength and droplet absorption are shown in Table 1.

Example 2

A mixed pulp slurry consisting of 25 parts of TMP, 70 parts of DIP and 5 parts of NBKP (all expressed as the weight of dry pulp) was prepared, and 1.3 parts of aluminum sulfate and 10 parts of calcium carbonate (available under trade name Optical HP from IMERYS; average particle diameter 1.5 μm) were added to 100 parts of this mixed pulp to prepare a neutralized newsprint base paper having a basis weight of 43 g/m$^2$, a thickness of 66 μm and an ash content of 15% in a twin-wire paper machine. A coating solution containing 8.0% of a cooked hydroxyethyl starch (available under trade name ETHYLEX 2025 from STALEY) and 0.48% of a sizing agent consisting of an alkenyl ketene dimer (available under trade name AS-1163 from Japan PMC Corporation) was prepared and applied on both sides of the newsprint base paper at a coating density of 0.8 g/m$^2$ (total on both sides) using a gate roll coater at a coating speed of 880 m/min.

Example 3

To 100 parts of a mixed pulp slurry having the same composition as used in Example 1 were added 2.1 parts of aluminum sulfate and 8 parts of clay (available under trade name 44 Clay from Daiharu KK) to prepare a neutralized newsprint base paper having a basis weight of 43.2 g/m$^2$, a thickness of 67 μm and an ash content of 3.9% in a twin-wire paper machine. This base paper is typical of light and acidic newsprint base papers. A newsprint paper was prepared in the same manner as in Example 1 except that this newsprint base paper was used.

Comparative Example 1

A newsprint paper was prepared in the same manner as in Example 1 except that an alkyl ketene dimer (available under trade name SK Resin from Japan PMC Corporation) was used as a sizing agent in place of the alkenyl ketene dimer used in Example 1.

Comparative Example 2

A newsprint paper was prepared in the same manner as in Example 1 except that a styrene-acrylic copolymer (available under trade name KN-520 from Harima Chemicals, Inc.) was used as a sizing agent in place of the alkenyl ketene dimer used in Example 1.

Comparative Example 3

A newsprint paper was prepared in the same manner as in Example 2 except that a coating solution containing 0.8% of a styrene-acrylic copolymer (available under trade name KN-520 from Harima Chemicals, Inc.) as a sizing agent in place of the alkenyl ketene dimer was prepared.

Comparative Example 4

A newsprint paper was prepared in the same manner as in Example 1 except that the acidic newsprint base paper used in Example 3 was treated with an alkyl ketene dimer (available under trade name SK Resin from Japan PMC Corporation) as a sizing agent in place of the alkenyl ketene dimer.

The static friction coefficient, kinetic friction coefficient, "neppari" strength, droplet absorption and contact angle of each of the newsprint papers obtained in Examples 1-3 and Comparative examples 1-4 were determined by the methods described below and the results are shown in Table 1.

Static and kinetic friction coefficients: determined according to ISO15359 using Amontons II from μMeasurement.

Adhesion strength: The coated faces of two pieces of each offset printing newsprint paper cut into 4×6 cm were wetted in water at a temperature of 20° C. for 5 seconds and then adhered together. The assembly was sandwiched between a pair of thin filter sheets and passed between rolls at a pressure of 50 kg/m$^2$ and conditioned at 25° C., 60% RH for 24 hours. A specimen of 3×6 cm was prepared from this assembly and then tested in a tensile tester at a tensile speed of 30 mm/min. As the measured value becomes greater, the specimen is harder to separate (i.e. more adhesive). In the present invention, "the stripping quality is good" when the "neppari" strength is 880 mN/3 cm or less.

Droplet absorption: determined with a 1 μwater droplet according to Japan TAPPI No. 33 (Test method for the rate of absorption of water by absorbent papers).

Contact angle: measured 0.1 second after placing a 5 μl water droplet on a felt surface (F-surface) using Dynamic Absorption Tester from Fibro.

TABLE 1

| | Coating amount (g/m$^2$) | Droplet absorption (seconds) | Contact angle (degree) | Adhesion strength (N/3 cm) | Static friction coefficient | Kinetic friction coefficient |
|---|---|---|---|---|---|---|
| Example 1 | 1.05 | 742 | 94.5 | 0.813 | 0.526 | 0.438 |
| Example 2 | 0.80 | 18 | 91.0 | 0.490 | 0.610 | 0.520 |
| Example 3 | 1.03 | 8 | 78.1 | 0.735 | 0.502 | 0.419 |
| Comparative example 1 | 1.05 | 964 | 99.2 | 0.823 | 0.429 | 0.287 |
| Comparative example 2 | 1.02 | 15 | 86.4 | 1.588 | 0.757 | 0.556 |
| Comparative example 3 | 0.80 | 9 | 81.3 | 1.078 | 0.650 | 0.554 |
| Comparative example 4 | 1.04 | 10 | 79.8 | 0.774 | 0.403 | 0.251 |

As shown in Table 1, the newsprint papers of Examples 1-3 coated with an alkenyl ketene dimer of the present invention as a sizing agent had a friction coefficient in an appropriate range and a low "neppari" strength, and especially, the newsprint papers of Examples 1 and 2 using a neutralized newsprint base paper showed sufficient sizing quality. However, the newsprint papers of Comparative examples 1 and 4 coated with an alkyl ketene dimer as a sizing agent showed a significant decrease in friction coefficients and the newsprint papers of Comparative examples 2 and 3 coated with a styrene-acrylic copolymer as a sizing agent showed high "neppari" strength, suggesting low printability.

What is claimed is:

1. A newsprint paper having a static friction coefficient in the range of 0.44-0.74 produced by applying a coating solution containing an alkenyl ketene dimer represented by general formula 1 below and a paper surface-modifying agent on a newsprint base paper and drying the base paper, wherein the newsprint base paper is a neutralized newsprint base paper containing 50% by weight or more of deinked pulp, and light calcium carbonate having an average particle diameter of 1.0 to 4.0 μm as a filler in an amount of 1% to 30% by weight based on the weight of the base paper,

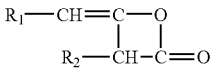

(1)

wherein $R_1$ and $R_2$ represent an unsaturated hydrocarbon group containing 8-30 carbon atoms.

2. The newsprint paper of claim 1 wherein a weight ratio of said alkenyl ketene dimer to said paper surface-modifying agent is 1/100-30/100.

3. The newsprint paper of claim 1, which does not contain an anti-slip agent.

4. The newsprint paper of claim 1, wherein the paper surface-modifying agent is a starch.

5. The newsprint paper of claim 1, wherein the paper surface-modifying agent is selected from the group consisting of oxidized starches, etherified starches, and esterified starched.

* * * * *